US007258958B2

(12) United States Patent
Itami et al.

(10) Patent No.: US 7,258,958 B2
(45) **Date of Patent: *Aug. 21, 2007**

(54) ORGANIC PHOTORECEPTOR, PROCESS CARTRIDGE, IMAGE FORMING APPARATUS, AND IMAGE FORMING METHOD

(75) Inventors: Akihiko Itami, Hachioji (JP); Kazuhisa Shida, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 378 days.

This patent is subject to a terminal disclaimer.

(21) Appl. No.: 10/869,634

(22) Filed: Jun. 15, 2004

(65) Prior Publication Data

US 2004/0265716 A1 Dec. 30, 2004

(30) Foreign Application Priority Data

Jun. 25, 2003 (JP) ..... 2003-180723

(51) Int. Cl.
*G03G 15/02* (2006.01)

(52) U.S. Cl. ..... 430/58.8; 430/58.05; 430/59.6; 430/58.65; 430/120; 430/60; 430/64; 430/65; 399/159

(58) Field of Classification Search ..... 430/58.8, 430/58.05, 59.6, 58.65, 120, 60, 64, 65; 399/159
See application file for complete search history.

(56) References Cited

U.S. PATENT DOCUMENTS 5,316,880 A * 5/1994 Pai et al. ..... 430/58.6
6,630,566 B1 * 10/2003 Allen et al. ..... 528/422

* cited by examiner

*Primary Examiner*—Mark A. Chapman
(74) *Attorney, Agent, or Firm*—Squire, Sanders & Dempsey L.L.P.

(57) ABSTRACT

An organic photoconductor, comprises a conductive base, a charge generating lager and a charge transport layer, wherein the charge generating lager and the charge transport layer are provided in this order on the conductive base, wherein when a curve is drawn by plotting integrated-values of a detected current in terms of time in measurement of transient photocurrent by TOF (time of flight) measurement with an electric field intensity of 10V/μm , crossing angle θ of two tangent lines tangent to the curve is 15° to 45°; and the charge transport lager has a film thickness of 20 to 35 μm.

17 Claims, 5 Drawing Sheets

ORGANIC PHOTORECEPTOR, PROCESS CARTRIDGE, IMAGE FORMING APPARATUS, AND IMAGE FORMING METHOD

BACKGROUND OF THE INVENTION

The invention relates to an organic photoreceptor (hereinafter also referred to merely as photoreceptor) used in the field of copy machines and printers, a process cartridge employing the organic photoreceptor, an image forming apparatus, and an image forming method.

DESCRIPTION OF RELATED ART

For a high image quality in electrophotographic images, there have been developed technologies that form a minute latent image, by the use of an exposure light source with a small spot diameter, on an organic photoreceptor to form a minute dot image. For example, there is known a method of forming a latent image with a high resolution on an organic photoreceptor, using a light source with a spot diameter not greater than 4000 μm (Patent Document 1 described later). In order to form a precise latent image by this small spot diameter exposure method, it is significant, when forming the latent image on an organic photoreceptor through image-wise exposure, to reduce diffusion of electric charge carriers which are generated by light exposure. In other words, it is necessary to secure an enough electric potential contrast between exposed and unexposed parts to accurately reproduce image data as an electrostatic latent image, and to achieve this, it is important to reduce diffusion of carriers before the generated carriers reach surface charges. It is reported (in Non-patent Document 1 described later) that if the ratio D/μ of a diffusion constant (D) to a drift mobility (μ) is great, influence of diffusion during electrostatic latent image forming is not negligible for image degradation of an image with a high density such as 1200 dpi for example, wherein, if the layer thickness of the charge transport layer is larger, degradation of latent images is greater. Further, it is also reported (in Non-patent Document 2 described later) that diffusion of latent images is greater with a greater drift mobility (μ) of the charge transport layer, according to the analysis result of a single dot latent image. Therefore, for a process with high resolution, an organic photoreceptor that has a thin charge transport layer to prevent diffusion of electrostatic latent images has been already offered (Patent Document 2).

However, these offered organic photoreceptors are not sufficient solutions in respect of the durability of a photoreceptor. Specifically, charging performance and sensitivity of an organic photoreceptor are greatly dependent on the layer thickness, in general, and decrease in the layer thickness due to repeated use tends to cause an increase in image defects such as fogging and black spots. Particularly, in an organic photoreceptor with a thin photoreceptive layer, loading conditions of charging potential when forming an electrostatic latent image tend to increase the electric filed intensity per unit layer thickness, which easily causes problems such as degradation of dot images and a rise of residual electric potential both resulting from repeated use.

Further, in recent electrophotographic apparatuses such as digital copying machines and printers, downsizing and speedup as well as high image quality have been achieved, and both a high sensitivity to respond to high speed, and a long life by improved abrasion resistance are required as characteristics of a photoreceptor.

To meet the above-mentioned requirements of high image quality, downsizing, and speedup, it is required to improve the time responsivity of the sensitivity of a photoreceptor. To satisfy these requirements, there have been made efforts to develop a charge generating material with a high sensitivity. As a result, as a representative charge generating material with a high sensitivity, phthalocyanine pigments (titanil phthalocyanine pigments having a maximum peak of Bragg angle 2θ at 27.3 degrees for a spectrum of characteristic X ray of CU-Kα) such as Y-type phthalocyanine have been developed, and electrophotographic photoreceptors employing such a pigment have been put into practical use (Non-patent Document 3). However, in a high speed image forming process in which the line speed of a photoreceptor is high, and charging time and moving time from an exposure process to a development process are short, these electrophotographic photoreceptors tend to be subjected to unsteadiness in charging potential, degradation of dot images, a rise of residual electric potential, fogging, and a drop in image density.

Namely, in an organic photoreceptor required to have a high image quality and a high speed, a change in the layer thickness of the photoreceptor due to repeated use affects the size of an electrostatic latent image of a dot image and forming of a potential contrast, thereby easily causing degradation of dot images, a rise of the residual electric potential, fogging, and a drop in image density. Particularly in the case of a print image of a photographic image, wherein a dot image with a resolution higher than 1200 dpi is required, and a tone reproducibility is emphasized, degradation of dot images caused by a decrease in layer thickness of a photoreceptor tends to be generated, which needs to be prevented.

[Patent Document 1]

TOKKAI No. H08-272197

[Patent Document 2]

TOKKAI No. H05-119503

[Non-patent Document 1]

Journal of the Imaging Society of Japan (Nihon Gazo Gakkai-shi) Vol. 38, No. 4, page 296

[Non-patent Document 2]

Fuji Jiho Vol. 75, No. 3, page 194

[Non-patent Document 3]

Denshi Shashin Gakkai-shi (Electrophotography: the society journal) 29 (3), 250 (1990)

SUMMARY OF THE INVENTION

An object of the present invention is to solve the above-stated problems of the prior art, and to provide an organic photoreceptor for forming electrophotographic images with a high resolution not lower than 1200 dpi, wherein degradation of size and contrast in forming a latent image of a dot image is prevented, and electrophotographic images with less drop of image density, high contrast, and high resolution can be formed, even if the organic photoreceptor is used for a long time and the layer thereof is abraded. The invention also provides a process cartridge employing the above photoreceptor, an image forming apparatus, and an image forming method.

The above object can be attained by the following structure.

An organic photoconductor, comprises:

a conductive base, a charge generating layer and a charge transport layer, wherein the charge generating layer and the charge transport layer are provided in this order on the conductive base, wherein when a curve is drawn by plotting integrated-values of a detected current in terms of time in measurement of transient photocurrent by TOF (time of flight) measurement with an electric field intensity of 10V/μm, crossing angle θ of two tangent lines tangent to the curve is 15° to 45°; and the charge transport layer has a film thickness of 20 to 35 μm.

BRIEF DESCRIPTIONS OF THE INVENTION

DETAILED DESCRIPTION OF THE PREFERRED EMBODIMENT

Figure 1:
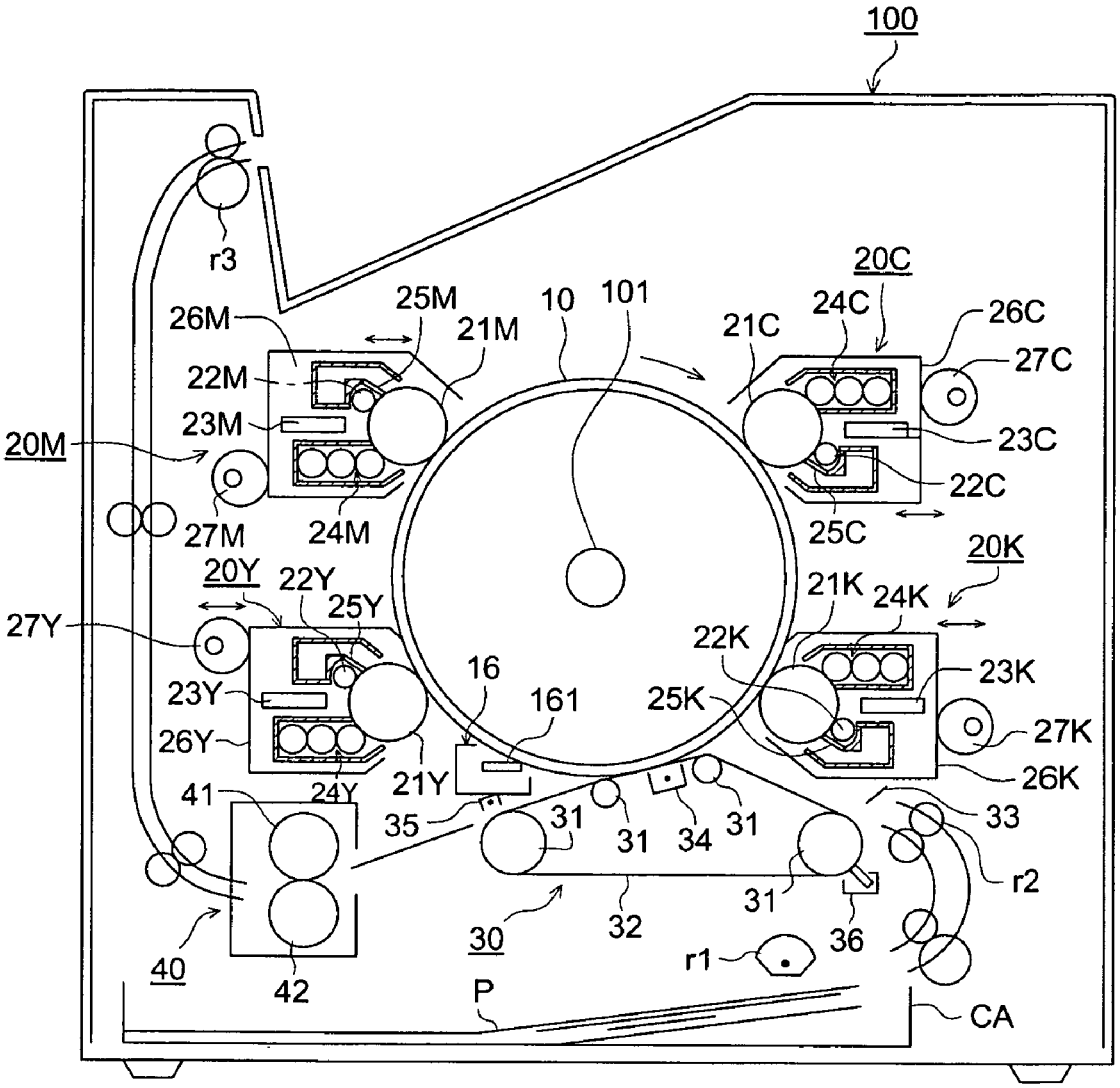
FIG. 1 is a cross-sectional construction diagram showing an example of an image forming apparatus of a tandem intermediate transfer type.

Firstly, preferable embodiments according to the present invention can be described.

The inventors intensively discussed about the above problems, and reached the conclusion that, to form an electrophotographic image with a high resolution not lower than 1200 dpi, it is important to prevent degradation of the size and contrast of an electrostatic latent image of a dot image caused by a decrease in the film thickness of a photoreceptor due to repeated use. In order to attain this, the inventors found that, it is possible to form a dot image with a small change, a high resolution, and a constant size and contrast, even if the layer thickness of the photoreceptor may vary, by preventing diffusion of carriers generated by image exposure onto a photoreceptor so that the size and the contrast of the electrostatic latent image of a dot image is less dependent on the layer thickness of the photoreceptor, and thus the invention was accomplished. That is, the distribution of carriers which was caused by the action of charging and image exposure was considered in terms of an entire organic photoreceptor, wherein the action includes generation of the carriers in a charge generating layer (hereinafter also referred to as CGL), injection of the carriers from the charge generating layer into a charge transport layer (hereinafter also referred to as CTL), and transportation of the carries in the CTL, the CGL and the CTL constructing the organic photoreceptor of the invention. Then, it proved to be possible to decrease the variation of an electrostatic latent image of a dot image due to the variation of the layer thickness, and reduce diffusion and shrinkage of a single dot image by properly dispersing the distribution of the carriers in the moving direction and lowering the spatial density of the carriers, even without forming the photoreceptor in a particularly thin thickness. Objects of the invention are accomplished by the following arrangement.

Item 1

An organic photoreceptor that is used in an electrophotographic image forming apparatus that writes a digital image with a resolution equal to or higher than 1200 dpi and forms an electrostatic latent image, wherein the organic photoreceptor comprises a structure of a sequential lamination of a charge generating layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

Item 2

The organic photoreceptor according to Item 1, wherein the layer thickness of the charge transport layer ranges from 20 to 35 μm.

Item 3

The organic photoreceptor according to Item 2, wherein the layer thickness of the charge transport layer ranges from 25 to 35 μm.

Item 4

The organic photoreceptor according to any of Item 1 to Item 3, wherein the organic photoreceptor further comprises a surface protective layer.

Item 5

A process cartridge that is freely mounted on and dismounted from an electrophotographic image forming apparatus that writes a digital image on an organic photoreceptor with a resolution equal to or higher than 1200 dpi, and forms an electrostatic latent image, wherein the process cartridge comprises at least one of a charging device, a developing device, a transfer device, and a cleaning device, and further comprises an organic photoreceptor having a structure of a sequential lamination of a charge generating layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

Item 6

An electrophotographic image forming apparatus that comprises at least an organic photoreceptor, a charging device, an exposure device, and a developing device, writes a digital image on the organic photoreceptor with a resolution equal to or higher than 1200 dpi, and forms an electrostatic latent image, wherein the organic photoreceptor comprises a structure of a sequential lamination of a charge generating layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

Item 7

The image forming apparatus according to Item 6, wherein the charging potential at the organic photoreceptor applied by the charging device ranges from 200 to 400 V.

Item 8

An image forming apparatus that comprises a plurality of image forming units, each image forming unit including at least an organic photoreceptor, a charging device and exposure device for writing a digital image with a resolution equal to or higher than 1200 dpi on the organic photoreceptor and forming an electrostatic latent image, a developing device for visualizing the electrostatic latent image into a toner image, and a transfer device for transferring the toner image formed on the organic photoreceptor onto a recording material, and forms a color image by sequentially transferring respective toner images formed by the use of toners in different colors for the respective image forming units onto a recording material, wherein the organic photoreceptor has a structure of a sequential lamination of a charge generating layer and a charge transport layer on a conductive support, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

Item 9

An image forming method that forms an electrophotographic image, using the image forming apparatus according to any one of the above Item 6 to Item 8.

Item 10

An organic photoreceptor that is used in an electrophotographic image forming apparatus that writes a digital image with a charging potential ranging from 200 to 400 V, and forms an electrostatic latent image of the digital image, wherein the organic photoreceptor has a structure of a sequential lamination of a charge generating layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

The invention will be described in detail below.

An organic photoreceptor of the invention comprises a structure of a sequential lamination of a charging layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

The above-mentioned structure of an organic photoreceptor allows forming a latent image of a dot image with a resolution equal to 1200 dpi or higher, and makes it possible to provide an organic photoreceptor which has a satisfactory fine-line reproducibility and prevents degradation of image quality even with repeated image forming for a large number of sheets.

An organic photoreceptor of the invention comprises a structure of a sequential lamination of a charging layer and a charge transport layer on a conductive base material, and a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm.

Assuming that the layer thickness of an insulating layer is 20 μm, measurement of transient photocurrent (TOF) for an electric field intensity of 10 V/μm means measurement under conditions in which a charging potential of 200 V is applied, wherein a transient photocurrent (TOF) for a relatively weak electric field intensity is measured. Regarding an organic photoreceptor of the invention, a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for a relatively weak electric field intensity, and the organic photoreceptor reduces carrier diffusion which occurs during the processes including generation of carriers in a charge generating layer (also referred to as CGL), injection of the carriers from the charge generating layer into a charge transport layer (also referred to as CTL), and transportation of the carriers in the CTL, and reduces variation of quality in an electrophotographic image of a high quality with a resolution equal to or higher than 1200 dpi. Thus, it is possible to prevent degradation of a satisfactory quality including fine-line reproducibility, tonal resolution, sharpness, and color image.

Next, an explanation will be given about the method of measuring a transient photocurrent (TOF) for an electric field intensity of 10 V/μm, and about the meaning that the crossing angle α formed by two tangent lines which are tangent to the curve obtained by plotting integral values of a detected current with respect to time is in the range from 15 to 45 degrees.

Measurement Conditions of TOF

Measurement of TOF can be carried out by a known ordinary method.

Wavelength of an exposure light source: A wavelength near the maximum sensitivity of the spectral sensitivity of a photoreceptor (a single wavelength light with a wavelength not shorter than 0.9 times the maximum sensitivity) is used.

In the present embodiment, a Xe flash lamp (manufactured by Hamamatsu Photonics K.K.) was employed as the exposure light source, and a monochromatic light with a wavelength of 780 nm having passed through a ND filter and a band path filter was used.

Exposure intensity was conditioned with a reference amount of light that can reduce the surface charge down to 1/10 or lower, and the measurement was carried out after confirming that a proper waveform could be detected.

Pulse emission time: 2 μ sec

Sampling speed: 1 μ sec

Charging potential V is set such that V/d becomes 10 V/μm, wherein d represents a total layer thickness of the charge generating layer, charge transport layer, and the insulating intermediate layer (not smaller than $10^8$ Ω·cm).

Next, explanation will be given about the meaning that the crossing angle α formed by two tangent lines which are tangent to a curve that is obtained by plotting integral values of a detected current with respect to time is in the range from 15 to 45 degrees.

Figure 5:
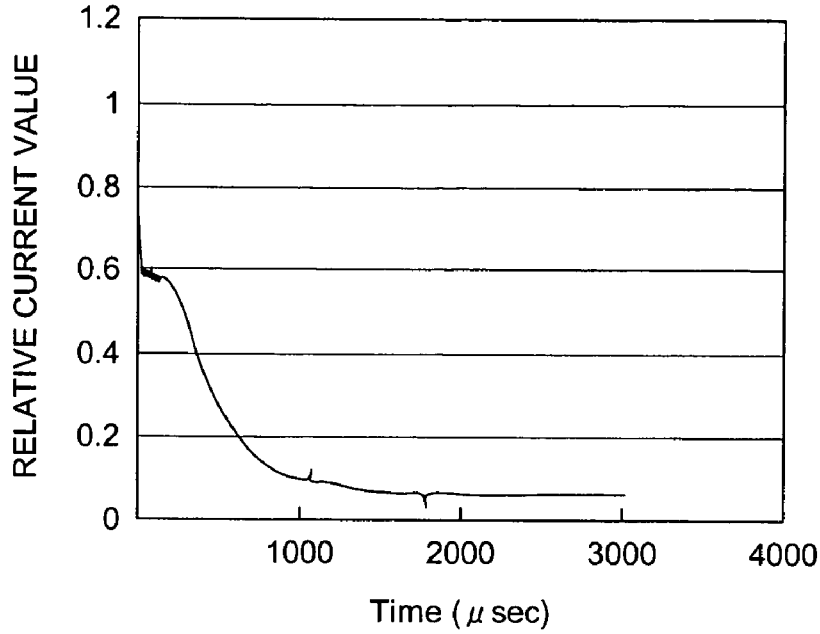
FIG. 5 shows data by measurement of a transient photocurrent (TOF) of an organic photoreceptor for an electric field intensity of 10 V/μm.

FIG. 5 shows data of measured transient photocurrent (TOF) of the photoreceptor for an electric filed intensity of 10 V/μm. The horizontal axis (X axis) represents time (μsec), and the vertical axis (Y axis) represents the detected current value (a relative current value standardized with the maximum current value represented by 1).

Figure 6:
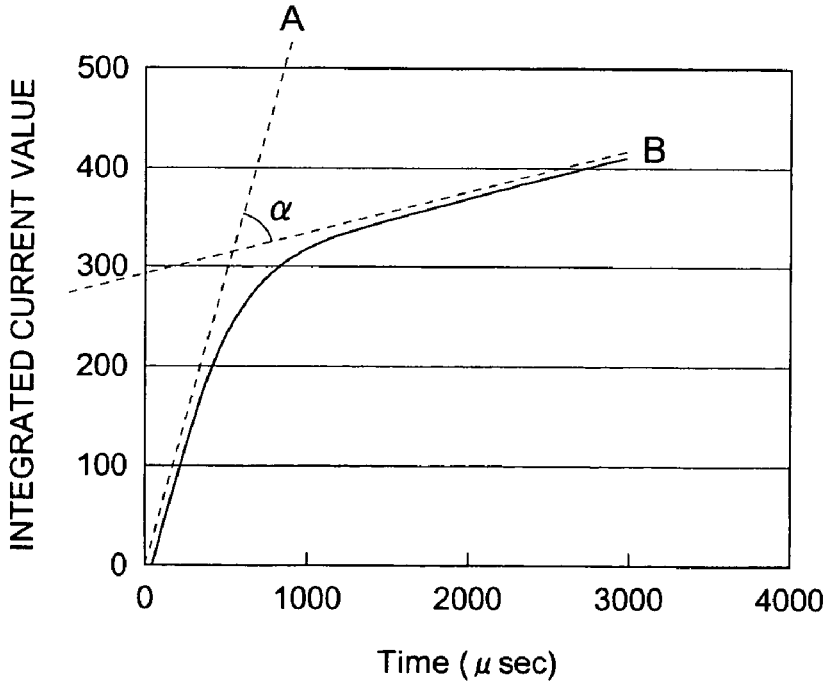
FIG. 6 shows a curve created by plotting integral values of a detection current obtained from the data in FIG. 5, with respect to time.

FIG. 6 shows a curve obtained by plotting integral values of the detected current with respect to time, the detected current being obtained from the data in FIG. 5. The horizontal axis (X axis) represents time (μsec), and the vertical axis (Y axis) represents the integral value of the detected current.

The tangent lines referred to in the invention are tangent line A starting at the point of intersection between X axis and Y axis, that is, the origin in FIG. 6, and tangent line B starting at 3000 μsec, wherein the crossing angle α formed by the tangent lines ranges from 15 to 45 degrees.

By arranging a photoreceptor of the invention such that the crossing angle α obtained by measurement for the electric field intensity of 10 V/μm ranges from 15 to 45 degrees, the resolution slightly depends on the layer thickness, and an image with a high resolution can be obtained even if the layer thickness decreases by the use for a long time. If the crossing angle α is smaller than 15 degrees, influence of carriers in delayed response is not negligible, causing problems such as a rise of electric residual potential with a repeated use. The crossing angle α is preferably in the range from 20 to 40 degrees.

Photoreceptors of the invention mean electrophotographic photoreceptors that are arranged to have, on an organic compound, at least one of a charge generating function and a charge transport function which are essential to electrophotographic photoreceptors, wherein photoreceptors of the invention include all types of known organic photoreceptors such as photoreceptors made of a known organic charge generating material and/or organic charge transport material, and photoreceptors made of a polymer complex having a charge generating function and a charge transport function.

A charge transport layer of the invention means a layer having a function to transport charge carriers, which are generated in a charge generating layer by light exposure, to the surface of an organic photoreceptor, wherein this charge transport function can be confirmed by laminating the charge generating layer and the charge transport layer on a conductive support and detecting optical-conductivity.

An organic photoreceptor of the invention has a basic structure of a photoreceptive layer comprised of a charge generating layer and a charge transport layer on a conductive support.

To give a characteristic, to an organic photoreceptor of the invention, that a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the organic photoreceptor for an electric field intensity of 10 V/μm, it is essential to select a combination of a charge generating material (CGM) to be used for an charge generating layer and a charge transport material (CTM) to be used for a charge transport layer. In the case of employing a pigment with a high efficiency of generating charge carriers (for example, Y type pigment described later) as the CGM, a CTM used for the charge transport layer lowers the injection efficiency of the charge carriers from the charge generating layer so that the distribution of the charge carriers in the charge transport layer is dispersed in the layer thickness direction to a proper degree, and thus it is possible to produce an organic photoreceptor for which the crossing angle α formed by the two tangent lines ranges from 15 to 45 degrees.

On the other hand, in the case of employing a pigment with a lower efficiency of generating charge carriers (for example, Ga type pigment described later) compared with a Y type pigment CGM, even if a CTM to be used for the charge transport layer does not lower the injection efficiency of the charge carriers from the charge generating layer to a great extent, the charge carriers injected into the charge transport layer come to have a time lag between them by themselves, and thus a proper dispersion of charge carriers in the direction of the layer thickness is achieved in the charge transport layer, making it possible to produce an organic photoreceptor in which the crossing angle α formed by the two tangent lines ranges from 15 to 45 degrees.

As mentioned above, in order to produce an organic photoreceptor of the invention, it is essential to select such a combination of a CGM and a CTM as described above. However, charge generating efficiency, charge injecting efficiency, and charge transportability also vary subtly with the binder resin of the charge generating layer and the binder resin of the charge transport layer. Therefore, it is necessary to make a proper selection in terms of a total combination including materials for the charge transport layer, the charge generating layer, and an intermediate layer described later so that the crossing angle α formed by the two tangent lines is set in the range from 15 to 45 degrees.

The specific structure of a photoreceptor to be used in the invention will be described below.

Conductive Support

A conductive support to be used in a photoreceptor of the invention has a sheet shape or a cylindrical shape.

A conductive support in a cylindrical shape in the invention means one that is necessary for endless forming of images by rotation, and it is preferably a conductive support having a straightness not greater than 0.1 mm and a run-out not greater than 0.1 mm. If the straightness and the run-out exceed these ranges, satisfactory image forming is difficult.

As a material to be used for the conductive support, there are given metal drums of aluminum, nickel, and the like, or plastic drums evaporated with aluminum, tin oxide, indium oxide, and the like, or paper/plastic drums coated with a conductive material. A conductive support preferably has a specific resistance equal to or smaller than $10^3$ Ωcm at a normal temperature.

A conductive support to be used in the invention may have a sealed alumite film formed on the surface thereof. Alumite processing is usually performed in an acid bath of chromic acid, sulfuric acid, oxalic acid, phosphoric acid, boric acid, sulfamic acid, or the like, wherein anodizing in sulfuric acid gives the most preferable result. In the case of anodizing in sulfuric acid, anodizing is preferably performed with a sulfuric acid concentration ranging from 100 to 200 g/l and aluminum ion concentration ranging from 1 to 10 g/l at a temperature of around 20° C., and with an applied voltage of about 20 V, but not limited to this. The average film thickness of the anodized layer is preferably equal to or smaller than 20 μm in usual cases, and it is especially preferable to be equal to or smaller than 10 μm.

Photoreceptor

Charge Generating Layer

A charge generating layer contains a charge generating material (CGM). In addition, the charge generating layer may contain a binder resin and other additives as necessary.

As charge generating materials of the organic photoreceptor of the invention, phthalocyanine pigments, azo pigments, perylene pigments, azulenium pigments can be used solely or in combination. Among these pigments, titanyl phthalocyanine pigments, gallium phthalocyanine pigments, perylene pigments are preferably employed. For example, titanyl phthalocyanine pigments having a maximum peak of Bragg angle 2θ for CU-Kα radiation at 27.2°, benzimidazole perylene having a maximum peak of 2θ of the same at 12.4°, chlorogallium phthalocyanine pigments having diffraction peaks of Bragg angle (2θ±0.2°) for a diffraction spectrum of characteristic X ray of CU-Kα at least at positions of 7.4°, 16.6°, 25.5°, and 28.3° in, and hydroxygallium phthalocyanine pigments having diffraction peaks at least at positions of 7.5°, 9.9°, 12.5°, 16.3°, 18.6°, 25.1°, and 28.1°, have almost no variation in charging performance and sensitivity due to repeated use, and are preferably used accordingly.

In case of using a binder as a dispersion medium of a CGM in the charge generating layer, a known resin can be employed as the binder, and the most preferable resins are formal resin, butyral resin, silicone resin, silicone modified butyral resin, phenoxy resin. The ratio of the binder resin to the charge generating material is preferably 100 weight parts of binder resin to weight parts of charge generating material ranging from 20 to 600. Increase in residual electric potential with repeated use can be minimized by using these resins. The layer thickness of a charge generating layer is preferably in the range of 0.1 to 2 μm.

Charge Transport Layer

The charge transport layer of an organic photoreceptor of the invention is basically constructed of a charge transport material (CTM), a binder resin having a function to disperse the CTM and to form a layer, and the like.

As a charge transport material, for example, triphenylamine derivatives, butadiene compounds, oxazole derivatives, oxadiazole derivatives, thiazole derivatives, thiadiazole derivatives, triazole derivatives, imidazole derivatives, imidazolone derivatives, imidazoline derivatives, bis-imidazolidine derivatives, styryl compounds, hydrazine compounds, benzidine compounds, pyrazoline derivatives, stilbene compounds, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazole, poly-1-vinylpyrene, poly-9-vinylanthracene, can be used solely or in combination. By combining a material, which is selected from these charge transport materials, with the above described charge generating material, an organic photoreceptor in which the crossing angle α between the two tangents ranges from 15° to 45° can be produced and a stable electrophotographic characteristics (charging performance, sensitivity, etc.) can be obtained, for which it is preferable to select a charge transport material from triphenylamine derivatives, styryl compounds, benzidine compounds and butadiene compounds. These charge transport materials are usually dissolved into a proper binder resin, and thus, a layer is formed.

As a binder resin of a charge transport layer, one with a small dielectric constant is preferably used, including polystyrene resins, styrene-butadiene copolymers for example.

A charge transport layer may contain additives such as antioxidants as necessary. As a binder resin to be used in the charge transport layer (CTL), although either a thermoplastic resin or a thermosetting resin can be used, a binder resin with a small dielectric constant is preferably used. Further, as a particularly preferable binder resin, it is especially preferable that polystyrene resin, styrene-butadiene copolymer, polycarbonate or the like, is used solely or in combination.

It is preferable that the ratio of a binder resin to a charge transport material is set as 100 weight parts of binder resin to weight parts of charge transport material ranging from 50 to 200.

Further, a charge transport layer may have a structure of a plurality of charge transport layers. The layer thickness of a charge transport layer is preferably in the range from 20 to 35 μm, and more preferably 25 to 35 μm.

Intermediate Layer

In the invention, an intermediate layer having a blocking function to prevent injection of charges from a conductive support is preferably provided between the conductive support and a photoreceptive layer.

As an intermediate layer having a blocking function, an undercoating layer using a polyamide resin, an intermediate layer containing inorganic particles and serving also as an undercoating layer, inorganic intermediate layer formed by an organic metal compound, a silane coupling agent, etc., and the like, are preferably employed to make the blocking function and adhesion to the conductive support or the charge generating layer to be compatible. An intermediate layer of the invention is virtually a semiconductive or insulating layer. A semiconductive or insulating layer is herein a layer with a volume resistance which is equal to or greater than $1\times10^{8}$ Ω·cm and preferably in the range from $1\times10^{8}$ to $1\times10^{15}$ Ω·cm. The volume resistance of an intermediate layer of the invention is preferably in the range from $1\times10^{9}$ to $1\times10^{14}$ Ω·cm, and more preferably $1\times10^{9}$ to $1\times10^{13}$ Ω·cm. The volume resistance can be measured as below.

Measurement conditions; conforming to JIS: C2318-1975

Measurement Instrument: Hiresta IP Manufactured by Mitsubishi Chemical Corporation Measurement conditions: Measurement probe HRS Applied voltage: 500 V Measurement environment: 30±2° C., 80±5 RH %

If the volume resistance is smaller than $1\times10^{8}$ Ω·cm, an intermediate layer is nearly conductive, and the electric field intensity tends to be smaller than 10 V/μm. Further, blocking of charges from the conductive support is lowered; the potential maintainability of the electrophotographic photoreceptor is degraded; image defects such as black spots tend to occur; and thus, a satisfactory image quality cannot be achieved. On the other hand, if the volume resistance is greater than $1\times10^{15}$ Ω·cm, residual potential tends to increase with repeated image forming, which makes it impossible to obtain satisfactory image quality.

In the invention, a layer with a volume resistance smaller than $1\times10^{8}$ Ω·cm is determined to be a conductive layer, and is subtracted from the total layer thickness of a photoreceptor to compute the electric field intensity (10 V/μm) in the invention.

As an intermediate layer in the invention, an intermediate layer containing N-type semiconductive particles on a conductive support is preferable.

N-type semiconductive particles are herein fine particles which have a characteristic that most conductive carriers thereof are electrons. The characteristic that most conductive carriers are electrons herein means a characteristic which efficiently blocks injection of holes from the base material and does not block electrons from the photoreceptive layer, which is achieved by providing the N-type semiconductive particles in an insulating binder.

A method for determination of N-type semiconductive particles will be described below.

An intermediate layer (which is formed by the use of a dispersion liquid prepared by dispersing particles with 50 weight % in a binder resin that forms the intermediate layer) with a thickness of 5 μm is formed on a conductive support. The intermediate layer is charged negatively to evaluate a light decay characteristic. The intermediate layer is further charged positively to evaluate a light decay characteristic likewise.

N-type semiconductive particles are particles that are dispersed in the intermediate layer if light decay after negative charging is greater than that after positive charging in the above-mentioned evaluation.

The N-type semiconductive particles specifically are titanium oxide ($TiO_2$), zinc oxide (ZnO), tin oxide ($SnO_2$), or the like, and in the invention, titanium oxide is preferably used, in particular.

The average particle diameter of N-type semiconductive particles used in the invention is preferably in the range from 10 nm to 500 nm by the number average primary particle diameter, more preferably 10 nm to 200 nm, and further preferably 15 nm to 50 nm.

An intermediate layer by the use of N-type semiconductive particles with a number average primary particle diameter in the above-mentioned range can cause fine dispersion in the layer, having enough potential stability and a function to prevent black spots.

The number average primary diameter of the N-type semiconductive particles is measured in such a way that, in the case of titanium oxide, for example, the particles are magnified 10000 times in observation with a transmission electron microscope; 100 particles are observed at random as primary particles; and the particles are measured for a number average diameter of Fere diameter by image analysis.

The shapes of N-type semiconductive particles used in the invention include a tree branch shape, a needle shape, a particle shape, and the like. As the crystal types of such shaped N-type semiconductive particles, in the case of titanium oxide for example, there are crystal types such as anatase type, rutile type, amorphous type, and the like, wherein any one of these crystal types or a mixture of more than one crystal type may be used. Particularly, a rutile type is most preferable.

Hydrophobic surface treatments which can be applied to N-type semiconductive particles includes one in which divided surface treatments of a plurality of times are conducted, and the last surface treatment out of the surface treatments of the plurality of times is performed with a reactive organic silicon compound. Among the surface treatments of the plurality of times, a surface treatment of at least once is a surface treatment with at least one kind or more which are selected from alumina, silica, and zirconia, and, the last surface treatment is preferably performed with the reactive organic silicon compound.

Alumina treatment, silica treatment, or zirconia treatment deposits alumina, silica, or zirconia on the surfaces of N-type semiconductive particles, wherein alumina, silica, or zirconia deposited on the surfaces may be a hydrate thereof. Surface treatment with reactive organic silicon compound employs a reactive organic silicon compound as the treatment liquid.

By performing surface treatments on N-type semiconductive particles such as titanium oxide particles more than once in this way, the surfaces of the N-type semiconductive particles are uniformly coated, and by using these N-type semiconductive particles, which having been subjected to the surface treatments, in the intermediate layer, there is obtained an excellent photoreceptor which achieves a high dispersibility of the N-type semiconductive particles such as titanium oxide particles or the like in the intermediate layer and does not cause image defects such as black spots.

An intermediate layer to be used in the invention is preferably formed by dispersing the above semiconductive particles in a binder resin. The binder resin for the intermediate layer can be a polyamide resin, a vinyl chloride resin, a vinyl acetate, or a copolymer resin containing more than one repeated unit of these resins. Among these undercoating resins, polyamide resin is preferable as a resin that can reduce a residual potential increase with repeated use. The average particle diameter of the semiconductive particles is preferably in the range from 0.01 to 1 μm. The layer thickness of such an intermediate layer is preferably in the range from 0.5 to 20 μm.

The shapes of titanium oxide particles used in the invention include a tree branch shape, a needle shape, a particle shape, and the like; and as the crystal types of titanium oxide in such shapes, there are crystal types such as anatase type, rutile type, amorphous type, and the like, wherein any one of these crystal types or a mixture of more than one crystal type may be used. Particularly, a rutile type in a particle shape is most preferable.

Titanium oxide particles in the invention are preferably subjected to surface treatment. One surface treatment includes divided surface treatments of a plurality of times, wherein the last surface treatment out of the surface treatments of the plurality of times is performed with a reactive organic silicon compound. Among the surface treatments of the plurality of times, a surface treatment of at least once is a surface treatment with at least one kind or more which are selected from alumina, silica, and zirconia, and, the last surface treatment is preferably performed with the reactive organic silicon compound.

Alumina treatment, silica treatment, or zirconia treatment deposits alumina, silica, or zirconia on the surfaces of titanium oxide particles, wherein alumina, silica, or zirconia deposited on the surfaces may be a hydrate thereof. Surface treatment with reactive organic silicon compound employs a reactive organic silicon compound as the treatment liquid.

By performing surface treatments on titanium oxide particles more than once in this way, the surfaces of the titanium oxide particles are uniformly coated, and by using these titanium oxide particles, which have been subjected to the surface treatments, in the intermediate layer, there is obtained an excellent photoreceptor which achieves a high dispersibility of the titanium oxide particles in the intermediate layer and does not cause image defects such as black spots.

The above reactive organic silicon compound can be those represented by the following general formula (1), but is not limited to those described below as long as a compound reacts, in condensation reaction, with a reactive group such as hydroxyl group on the surface of titanium oxide.

General formula (1)

$$(R)_n—Si—(X)_{4-n}$$

(In the formula, Si represents a silicon atom, R represents an organic group in which carbon is in direct coupling with the silicon atom, X represents a hydrolysable group, and n represents integers from 0 to 3.)

In the organic silicon compound represented by the general formula (1), the organic groups in the form where carbon is directly bound to the silicon atom include alkyl groups such as methyl, ethyl, propyl, butyl, pentyl, hexyl, octyl and dodecyl, aryl groups such as phenyl, tolyl, naphthyl and biphenyl, epoxy-containing groups such as γ-glycidoxypropyl and β-(3,4-epoxycyclohexyl)ethyl, (meth) acryloyl-containing groups such as γ-acryloxypropyl and γ-methacryloxypropyl, hydroxyl-containing groups such as γ-hydroxypropyl and 2,3-dihydroxypropyloxypropyl, vinyl-containing groups such as vinyl and propenyl, mercapto-containing groups such as γ-mercaptopropyl, amino-containing groups such as γ-aminopropyl and N-β(aminoethyl)-γ-aminopropyl, halogen-containing groups such as γ-chloropropyl, 1,1,1-trifluoropropyl, nonafluorohexyl and perfluorooctylethyl, and additionally, nitro-, cyano-substituted alkyl groups. The hydrolytic groups of X include alkoxy groups such as methoxy and ethoxy, halogen groups and acyloxy groups.

An organic silicon compound represented by the general formula (1) may be used solely or in combination of two or more compounds.

In the case that n is greater than 1 in a concrete compound that is an organic silicon compound expressed by general formula (1), each of a plurality of Rs may be the same or different from each other. Also, in the case that n is smaller than 3, each of a plurality of X may be the same or different from each other. Further, in the case that more than one kind of organic silicon compounds expressed by the general formula (1) are used, R and X may be the same or different from each other between the respective compounds.

A polysiloxane compounds is a reactive organic silicon compound which is preferably used for surface treatment. Polysiloxane compounds of a molecular weight in the range from 1000 to 20000 are usually available and have a satisfactory function for preventing black spots.

Particularly, when methylhydrogen polysiloxane is used in the last surface treatment, an excellent effect can be obtained.

Solvents or dispersion agents which are used to form layers such as an intermediate layer, a charge generating layer, a charge transport layer, etc. are n-butylamine, diethylamine, ethylenediamine, isopropanolamine, triethanolamine, triethylenediamine, N,N-dimethylformamide, acetone, methylethylketone, methylisopropylketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl Cellosolve, and the like. Although the invention is not limited to these, dichloromethane, 1,2-dichloroethane, methylethylketone and the like are preferably used. These solvents can be used solely or as a mixed solvent of more than one kind.

As a coating processing method for producing organic photoreceptors, a coating processing method such as immersion coating, spray coating, or circular amount control type coating is performed, wherein spray coating or the circular amount control type coating method (represented by a circular slide hopper type) is preferably used for uniform coating in order that a lower layer is not dissolved by coating of an upper layer of a photoreceptor. Incidentally, the circular amount control type coating method is most preferably used to coat a protective layer. The aforesaid circular amount control type coating is described in TOKKAI No. S58-189061 in detail.

FIG. 1 is a cross-sectional construction diagram showing an example of an image forming apparatus of a tandem intermediate transfer system.

In this example, an image forming apparatus having a drum type intermediate transfer device superimposes color toners, the color toners being developing agents, on transfer device 10, thereby forms a color image, and transfers the color image onto recording sheet P which is a recording material (support of a final image: plain paper, transparent sheet, etc.).

Transfer device 10 sequentially superimposes and holds yellow (Y), magenta (M), cyan (C), and black (K) toner images formed by four image forming units 20Y, 20M, 20C, and 20K which are disposed around the transfer device 10. The transfer device 10 is a dram shaped transfer member which is provided with conductive rubber layer 12 (an urethane rubber layer with a thickness of 500 to 5000 μm and an electrical resistance of $10^8$ to $10^{14}$ Ω·cm) as an elastic layer on aluminum base member 11 which is a cylindrical metal base member, and separative film 13 (a Teflon (R) layer for separation with a thickness of 20 to 200 μm and an electrical resistance of $10^{10}$ to $10^{16}$ Ω·cm) on the transfer member 10. Around the transfer member 10, there are disposed the four image forming units 20Y, 20M, 20C, and 20K, recording sheet transfer device 30, and cleaning device 16. The transfer member 10 is supported by shaft 101 rotatably with respect to color image forming apparatus 100.

The four image forming units 20Y, 20M, 20C, and 20K are provided in respective frames 26Y, 26M, 26C, and 26K, the frames 26Y, 26M, 26C, and 26K being movably arranged in the color image forming apparatus 100; and there are provided moving members 27Y, 27M, 27C, and 27K for moving the respective image forming units to an image transfer position or a non image forming position, according to a color to be used, with respect to the drum-shaped transfer member 10, wherein the moving members are arranged to be in contact with the respective frames 26Y, 26M, 26C, and 26K.

The four image forming units 20Y, 20M, 20C, and 20K are respectively comprised of photoreceptor drams 21Y, 21M, 21C, and 21K, and around the respective photoreceptor drams, rotatable charging devices 22Y, 22M, 22C, and 22K, image-wise exposure devices 23Y, 23M, 23C, and 23K, rotatable developing devices 24Y, 24M, 24C, and 24K, and cleaning devices 25Y, 25M, 25C, and 25K for cleaning the respective photoreceptor drums 21Y, 21M, 21C, and 21K.

The image forming units 20Y, 20M, 20C, and 20K are of the same structure except that the colors of toner images which the image forming units respectively form on the transfer member 10 are different, which will be explained below in detail referring to FIG. 2 (a cross-sectional construction diagram of an image forming unit to be used in the image forming apparatus of the invention), taking the case of the image forming unit 20Y.

In the image forming unit 20Y being provided in the frame 26Y, around the photoreceptor drum 21Y which is an image forming member, there are disposed the image forming member charging device 22Y (hereinafter, referred to merely as charging device 22Y or charger 22Y), the exposure device 23Y, the developing device 24Y, and the image forming member cleaning device 25Y (hereinafter referred to merely as cleaning device 25Y or cleaning blade 25Y), wherein the image forming unit 20Y forms a yellow (Y) toner image on the photoreceptor drum 21Y. In the present embodiment, the image forming unit 20Y is arranged such that the photoreceptor drum 21Y, the charging device 22Y, the developing device 24Y, and the cleaning device 25Y, at least, are integrally provided therein.

The charging device 22Y is a means for applying a uniform electric potential to the photoreceptor drum 21Y. In the present embodiment, charger 22Y in use has a roller shape, and comes in contact with and is rotated by the photoreceptor drum 21Y.

According to an image signal (yellow), the exposure device 23Y exposes light on the photoreceptor drum 21Y that is given a uniform potential by the roller shaped charger 22Y, and thereby forms an electrostatic latent image that corresponds to a yellow image. As the exposure device 23Y, there is used a device that is comprised of an LED in which luminous devices are disposed in an array in the axial direction of the photoreceptor 21Y and an image forming device (Brand name: Selfoclens), or a laser optical system, etc.

It is assumed that a digital image is written on an organic photoreceptor of the invention with a resolution of 1200 dpi or higher, and an electrostatic latent image is formed. In order to form an electrostatic latent image of a dot image with such a high resolution on the photoreceptor, it is preferable to use an exposure light beam having a spot area of $5.00\times10^{-10}$ $m^2$ (500 $\mu m^2$) or smaller to conduct image-wise exposure.

Even with such a small diameter beam light exposure, a photoreceptor of the invention can faithfully form an electrostatic latent image corresponding to the spot area, thereby achieving an electrophotographic image with a satisfactory sharpness and a high contrast, wherein the electrophotographic image is a dot image with a resolution of 1200 dpi (number of dots per 2.54 cm) or higher. The number of dots of a dot image formed on a photoreceptor of the invention is 1200 dip or higher, preferably in the range from 1200 to 3000 dpi, and more preferably 1200 to 2500 dpi. For a larger number of dots of a dot image, it is necessary to make the spot area of the exposure light beam smaller when exposing the light on the photoreceptor.

The spot area of the exposure light beam means the area corresponding to the region in which light intensity is not smaller than $1/e^2$ of a maximum peak intensity on a light intensity distribution plane that appears on a cross-section which is obtained by cutting the exposure light beam with a plane vertical to the beam.

For a light beam to be used, a scanning optical system employing a semiconductor laser, a solid scanner of LED or a liquid crystal shutter, or the like can be applied. Gauss distribution, Lorenz distribution, or the like can be applied as a light intensity distribution, wherein a spot area is defined by a region in which the light intensity is not smaller than $1/e^2$ of the respective peak intensity.

The developing device 24Y is a means for storing a yellow toner, which is a developing agent, and conducting reversal development of an electrostatic latent image formed on the photoreceptor drum 21Y to form a yellow toner image. In the developing device 24Y of the present embodiment, the yellow toner stored in the developing device 24Y is stirred with stirring member 241Y, and then is supplied to developing sleeve 243Y by toner supply roller 242Y which has an elastic surface (sponge) and rotates in the arrow direction, wherein the yellow toner on the developing sleeve 243Y is formed into an even thin layer by thin layer forming member 244Y. For the developing action by the developing device 24Y, a direct-current developing bias or one further added with an alternating current is applied to the developing sleeve 243Y rotating in the arrow direction; jumping development is performed by a component stored by the developing device 24Y; a bias in which a direct current component and an alternating current component of the same polarity as that of the toner are superimposed is applied to the grounded photoreceptor 21Y; and thus non-contact reverse development is performed. Incidentally, stopper rollers provided at both ends, outside of the image region, of the developing sleeve 243Y touch the photoreceptor drum 21Y so that the developing sleeve 243Y and the photoreceptor drum 21Y are maintained to have no contact with each other. Also, contact development can be applied instead of non-contact development.

The yellow toner image formed on the photoreceptor drum 21Y is sequentially transferred onto transfer member 10 to which a bias voltage with a polarity opposite to that of the toner is applied, while stopper rollers are rotating in contact with a position determination section of the transfer member 10.

The cleaning device 25Y is a means for removing residual yellow toner on the photoreceptor drum 21Y after the yellow toner image is transferred onto the transfer member 10. In the present embodiment, the residual toner is removed when the cleaning device 25Y rubs on the photoreceptor drum 21Y.

In such a manner, the yellow toner image, which corresponds to an image signal (yellow), formed by the image forming unit 20Y through charging, exposure, and development processes, is transferred onto the transfer member 10.

As shown in FIG. 1, also in the other image forming units 20M, 20C, and 20K, a magenta toner image corresponding to an image signal (magenta), a cyan toner image corresponding to an image signal (cyan), and a black toner image corresponding to an image signal (K) are likewise formed on the respective photoreceptor drums 21M, 21C, and 21K in parallel and in synchronization. The toner images formed on the respective photoreceptor drums 21Y, 21M, 21C, and 21K of the image forming units 20Y, 20M, 20C, and 20K by this operation, are sequentially transferred onto the transfer member 10 to which a transfer bias in the range from 1 to 2 kV has been applied, and the toner images are superimposed. When all the toner images are superimposed, a color toner image is formed on the transfer member 10.

On the other hand, sheet feeding cassette CA, which is a recording material storing device, is provided below the transfer member 10. Recording sheet P, which is a recording material stored in the sheet feeding cassette CA, is taken out of the sheet feeding cassette CA by operation of sheet feeding roller r1, and conveyed to a pair of timing rollers r2. The paired timing rollers r2 feed out the recording sheet P in synchronization with the color toner image formed on the transfer member 10.

The color toner image formed on the transfer member 10 is transferred by recording sheet transfer device 30 at a transfer position onto the recording sheet P thus fed out. The recording sheet transfer device 30 is comprised of grounded roller 31, transfer belt 32, paper charger 33, transfer electrode 34, and paper sheet separating AC neutralizer 35.

The recording sheet P thus fed out is trained about rollers 31, and conveyed to the transfer position by the transfer belt 32 rotating in the arrow direction in synchronization with the circumferential velocity of the transfer member 10. The transfer belt 32 is a belt-shaped one having a high resistance in the range from $10^6$ to $10^{10}$ Ω·cm. In this operation, the recording sheet P is paper-charged to be of the same polarity as the toner by the paper charger 33 as a recording material charging device, and is absorbed by the transfer belt 32 to be conveyed to the transfer position. By paper-charging the recording sheet P to the same polarity as that of the toner, the recording sheet P and the color toner image on the transfer member 10 are prevented from attracting each other, thereby preventing degradation of the color toner image. As the recording material charging device, there is used an energizing roller, a brush charger, or the like which is attachable and detachable to and from the transfer belt 32.

The color toner image on the transfer member 10 is transferred onto the recording sheet P by the transfer electrode 34 at the transfer position. By this transfer electrode 34, a corona discharge is applied to the rear side of the recording sheet P so that the electric potential thereof becomes in the range from 1.5 to 3 kV, which is higher than that of the bias of the transfer member 10 and of a polarity opposite to that of the toner.

The recording sheet P, onto which the color toner image has been transferred, is further conveyed by the transfer belt 32, then, is neutralized by the paper sheet separating AC neutralizer 35 for separating recording materials, and is separated from the transfer belt 32 to be conveyed to fixing device 40. In the fixing device 40, the color toner image is heated and pressed by heat roller 41 and pressure roller 42, thus fused and fixed on the recording sheet P, and then, the recording sheet P is ejected by paired sheet ejection rollers r3 onto a tray provided on an upper part of the color image forming apparatus.

On the other hand, the transfer member 10 from which the color toner image has been transferred to the recording sheet P is slidingly rubbed by cleaning blade 161 of transfer member cleaning device 16, and thus, residual toner on the transfer member 10 is removed for cleaning. A blade of transfer belt cleaning device 36 slidingly contacts with the transfer belt 32 to clean the transfer belt 32 after the separation of the printing sheet.

Figure 2:
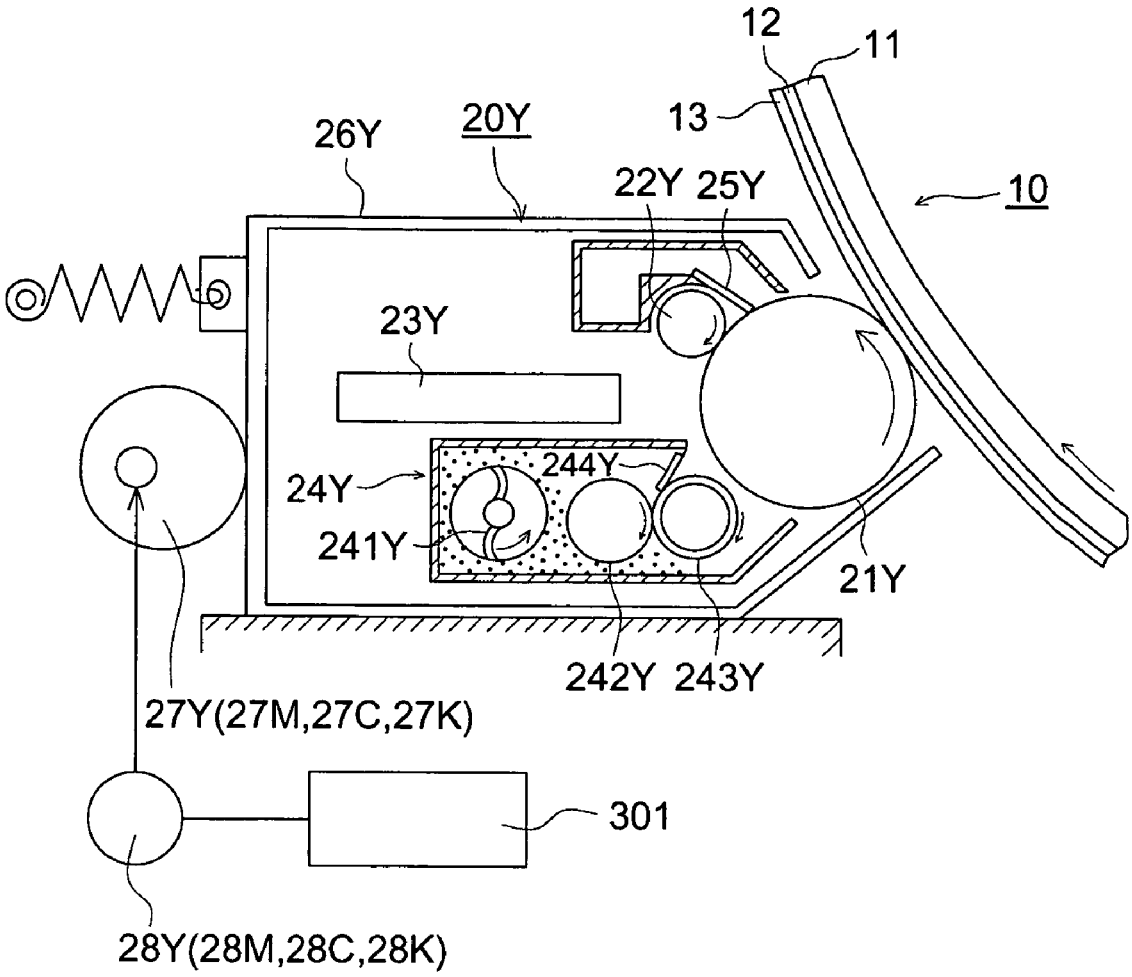
FIG. 2 is a cross-sectional construction diagram of an image forming unit to be used in an image forming apparatus of the invention.

Although the image forming unit shown in FIG. 2 is arranged to be a process cartridge which can attach and detach the developing device and the photoreceptor drum to and from the image forming unit, a process cartridge of the invention is not limited to this, and any process cartridge can be employed as long as the process cartridge includes at least one of a photoreceptor, a charging device, an image exposure device, a developing device, a transfer device, a separation device, and a cleaning device.

Figure 3:
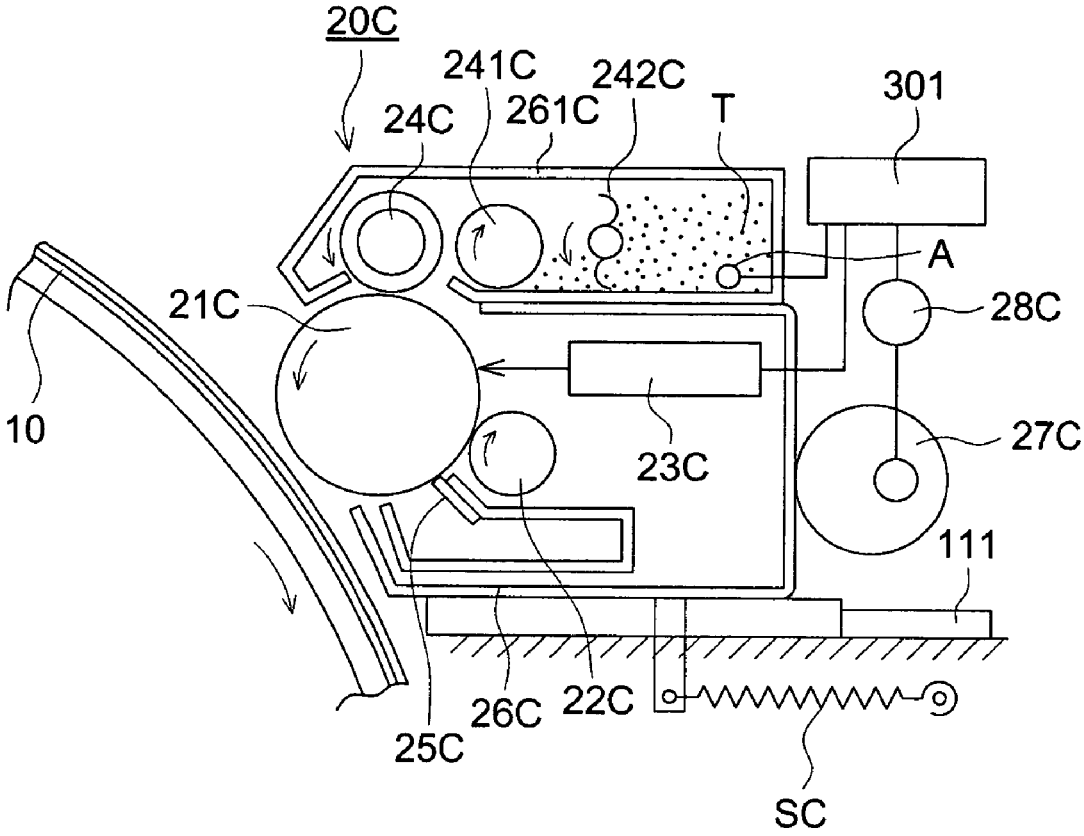
FIG. 3 is a cross-sectional construction diagram showing another example of an image forming unit to be used in an image forming apparatus of the invention.

FIG. 3 is a cross-sectional construction diagram showing another example of an image forming unit to be used in an image forming apparatus of the invention. FIG. 3 is a cross-sectional view of the image forming unit having a different structure from that of the image forming unit, shown in FIG. 2, and including a process cartridge that allows a developing device and a photoreceptor drum to attach and detach to and from the image forming unit.

The present embodiment will be described taking the case of the structure of image forming unit 20C. Frame 26C constructing the image forming unit 20C is arranged at guide member 111 that is provided in the color image forming apparatus, and moving member 27C of a cam structure is arranged in contact with a part of the frame 26C, wherein the moving member 27C is stopping the image forming unit 20C together with the frame 26C at a predetermined image forming position against spring SC. In the frame 26C, charging device 22C and exposure device 23C are disposed around photoreceptor drum 21 that is an image forming member; and in second frame 261C serving as a replaceable process cartridge arranged to be attachable and detachable to and from the frame 26C, developing device 24C, developing agent supply device 241C, and developing agent stirring device 242C are provided, wherein the developing device 24C is disposed facing around the photoreceptor drum 21C.

Further, the second frame 261C stores a cyan (C) toner of a monocomponent developing agent T, and a developing agent remaining amount detecting device A for detecting the remaining amount of the monocomponent developing agent is arranged in the developing device 24C.

A cyan (C) toner image is formed on the photoreceptor drum 21C by the image forming process, and the cyan (C) toner image is transferred from the photoreceptor drum 21C to the transfer member 10 in the same way as described before, wherein cleaning device 25C is disposed to clean a surface of the photoreceptor 21C after the transfer of the cyan (C) toner image.

Figure 4:
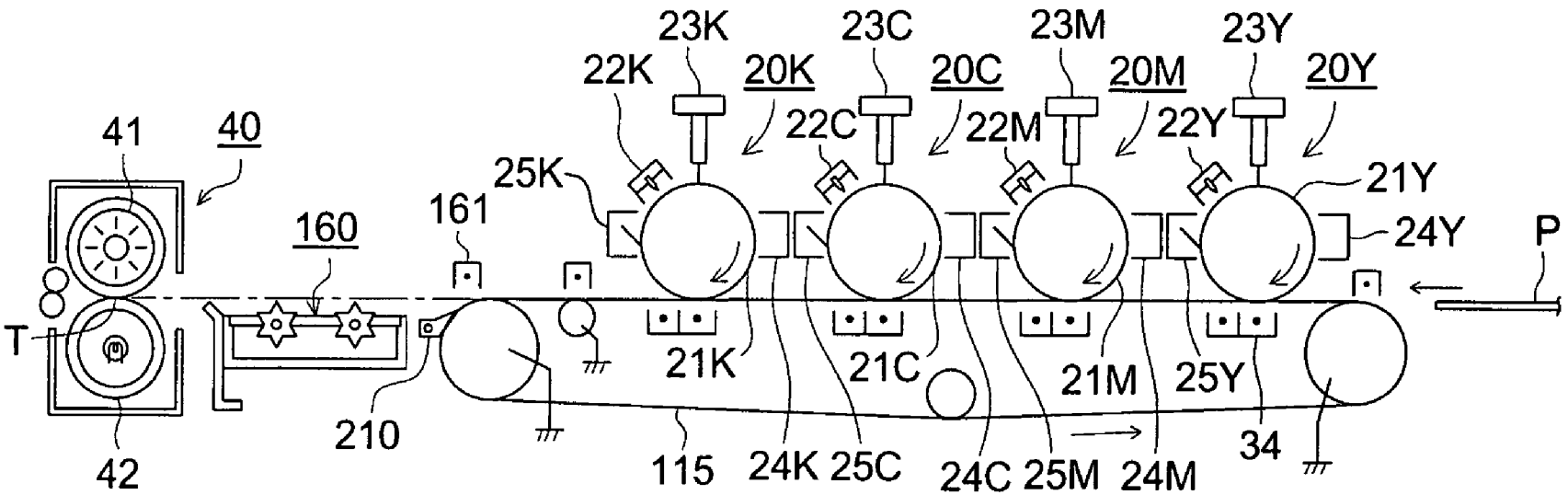
FIG. 4 is a cross-sectional construction diagram of another image forming apparatus of the invention.

FIG. 4 is a cross-sectional construction diagram of another example of an image forming apparatus of the invention. FIG. 4 shows an image forming apparatus that performs direct transfer onto a recording material on a transfer belt. The image forming procedure in FIG. 4 is almost the same as that in FIGS. 1 to 3, except that transfer is performed directly on the recording material instead of an intermediate transfer member.

The image forming apparatus, in FIG. 4, that performs direct transfer onto the recording material on the transfer belt will be described. FIG. 4 shows an example of color image forming by a tandem color image forming apparatus in which four photoreceptors are disposed in parallel and toner images in four colors of yellow (Y), magenta (M), cyan (C), and black (K) are sequentially transferred.

In FIG. 4, there are provided image forming units 20Y (20M, 20C, and 20K), for Y, M, C, and K, that are comprised of photoreceptor drums 21Y (21M, 21C, and 21K), scorotoron chargers (charging device) 22Y (22M, 22C, and 22K), exposure optical systems (exposure devices), developing devices 24Y (24M, 24C, and 24K), and cleaning devices 25Y (25M, 25C, and 25K). Respective toner images formed by the image forming units of Y, M, C, and K are sequentially transferred by transfer devices 34Y (34M, 34C, and 34K) with a synchronized feeding of a recording material (recording sheet P) to be formed into a superimposed color toner image.

The recording sheet is conveyed by conveyor belt 115, and separated from the conveyor belt by neutralizing operation of paper sheet separating AC neutralizer 162 serving as a recording material separating device and by separating claw 210 that is a separating member arranged with a predetermined gap from the conveyor section 160.

Further, the recording sheet P is passed through the conveyor section 160, thereafter, conveyed to fixing device 40 that is comprised of heat roller 41 and pressure roller 42, sandwiched by nip section T formed by the heat roller 41 and the pressure roller 42, then the superimposed toner image is fixed on the recording sheet P by applied heat and pressure, and thereafter the recording sheet P is ejected outside the apparatus.

EMBODIMENTS

The invention will be described in detail with embodiments. However, embodiments of the invention are mot limited to these. Incidentally, "part" in the description represents "weight part".

Embodiment 1

Preparation of Photoreceptors Group 1

<Intermediate Layer (UCL)>

The following liquid coating composition was prepared and coated on a cleaned cylindrical aluminum base member with a diameter of 30 mm, by an immersion coating method, to form an intermediate layer.

| (Preparation of intermediate layer dispersion liquid) | |
|---|---|
| Binder resin (polyamide resin) | 1 part |
| Anatase type titanium oxide (primary particle diameter 35 nm; ethyl fluoride trimethoxysilane for surface treatment) | 3.0 parts |
| Isopropyl alcohol | 10 parts |

The above components were mixed, dispersed by a batch method for 10 hours using a sand mill disperser, and thus an intermediate dispersion liquid was prepared.

The intermediate layer dispersion liquid was diluted twice with the same mixing solvent, then, was left over a night, then filtered (filter: rigimesh filter, manufacturer: Nihon Pall Ltd., nominal filtering accuracy: 5 micron, pressure: 50 kPa), and thus an intermediate layer liquid coating composition was prepared. The liquid coating composition was coated on the cylindrical aluminum base member by an immersion coating method, then heated at 120° C. for an hour, and thus, an intermediate layer with a dry thickness of 4.0 μm was formed. The volume resistance of the intermediate layer after drying was $3\times10^{13}$ Ω·cm under the measurement conditions described above.

| <Charge generating layer (CGL)> | |
|---|---|
| Charge generating material (G-1) | 20 parts |
| Polyvinyl butyral (#6000-C manufactured by Denki Kagaku Kogyo Kabushiki Kaisha) | 10 parts |
| 2-butanone | 700 parts |
| 4-Methoxy-4-methyl-2-pentanone | 300 parts |

The above composite was mixed, dispersed using a sand mill, and thus a charge generating layer liquid coating composition was prepared. This liquid coating composition was coated by an immersion coating method, and a charge generating layer with a dry layer thickness of 0.3 μm was formed on the intermediate layer.

| <Charge transport layer (CTL)> | |
|---|---|
| Charge transport material (T-1) | 200 parts |
| Polycarbonate (Z300 manufactured by Mitsubishi Chemical Corporation | 300 parts |
| Antioxidant (Irganox1010 manufactured by Nihon Chiba Geigy Co.) | 6 parts |
| Dichloromethane | 2000 parts |
| Silicon oil (KF-54 manufactured by Shin-Etsu Chemical CO., Ltd. | 1 part |

These were mixed, dissolved, and thus a liquid coating composition for a charge transport layer was prepared. This liquid coating composition was coated on the charge generating layer by a circular amount control type coating method, dried at 105° C. for 70 minutes, and a charge transport layer of a dry thickness of 25 μm was formed, and thus, photoreceptor Group 1 (4 photoreceptors produced in the same manner for tandem use) for which the concentration of the residual solvent is 100 ppm or lower was prepared. Preparation of photoreceptor Groups 2 to 13

Photoreceptor Groups 2 to 13 were prepared in the same way as in preparation of the photoreceptor Group 1 except that the charge generating material G-1, the charge transport material T-1, and the dry layer thickness 25 μm of the charge transport material were changed as shown in Table 1. Preparation of photoreceptors 1T to 13T for measurement of TOF Photoreceptors 1T to 13T for measurement of TOF, each photoreceptor being provided with an intermediate transfer layer, charge generating layer, and charge transport layer, were prepared in the same manner as the preparation of the photoreceptor Groups 1 to 13 except that the cylindrical aluminum base member with a diameter of 30 mm was replaced by a support prepared by vapor depositing of aluminum on a PET base.

<Evaluation 1: Evaluation of TOF>

Transient photocurrents (TOF) of the respective photoreceptors were measured under the above-mentioned measurement conditions of TOF, using the photoreceptors 1T to 13T, then respective curves, as shown in FIG. 6, were made by plotting integral values of detected currents with respect to time from measured data of the transient photocurrents (TOF). Crossing angles α formed by a transient line A starting from the origin of the respective photoreceptors and a tangent line B starting from 3000 μsec was obtained from the respective curves. The charging potential V in the measurement of TOF was set such that V/d becomes 10 V/μm, wherein d represents the total layer thickness of the intermediate layer, the charge generating layer, and the charge transport layer. The results are shown in Table 1.

<Evaluation 2: Image Evaluation>

The respective photoreceptor groups were mounted in a combination shown in Table 1 on a 1200 dpi digital color printer (exposure light wavelength 650 nm) based on the image forming apparatus shown in FIG. 1, and monochrome images and color images, in which both characters and halftones are present in a pixel ratio of 8%, were continuously printed on 50,000 A4 size sheets at a normal temperature and humidity (20° C. and RH 50%) Taking the printing ratio of monochrome printing to color printing with a tandem type color image forming apparatus into account, the ratio of the number of monochrome images to that of color images in printing was set to a ratio of 9 sheets of monochrome images to 1 sheet of color image, namely 9:1. During printing, printing was suspended when necessary for the following evaluations. The evaluation items and criteria are described below. Evaluation results are shown in Table 1.

Evaluation Items and Criteria for Evaluation

"Dot Reproducibility of Monochrome Image"

Reproducibility of dots forming a black image was observed with a 100 times magnifier and evaluated. The dot reproducibility was evaluated with black images at the start of printing (S), after printing 10,000 sheets (10,000), and after printing 50,000 sheets (50,000).

A: Dot images are produced with increase or decrease of less than 30% in area compared with the exposure spot area, wherein the respective dot images are reproduced uncombined.

(Excellent)

B: Dot images are produced with increase or decrease ranging from 30 to 60% in area compared with the exposure spot area, wherein the respective dot images are reproduced uncombined. (Practical level)

C: Dot images are produced with increase or decrease exceeding 60% in area compared with the exposure spot area, wherein the respective dot images are partially lost or connected. (Impractical level)

"Dot Reproducibility of Color Image"

Reproducibility of dots forming a color image was observed with a 100 times magnifier and evaluated. The dot reproducibility was evaluated with color images at the start of printing (S), after printing 10,000 sheets (10,000), and after printing 50,000 sheets (50,000).

A: A color image is reproduced with little unevenness between the respective dots of Bk, Y, M, and C (The difference between the area of the largest dot and the area of the smallest dot is smaller than 30% for each color.), and the color balance of the color image is excellent.

(Excellent)

B: A color image is reproduced with unevenness between the respective dots of Bk, Y, M, and C, wherein the difference between the area of the largest dot and the area of the smallest dot ranging from 30 to 60% for each color, and the color balance of the color image is maintained.

(Practical Level)

C: A color image is reproduced with a significant unevenness between the respective dots of Bk, Y, M, and C (The difference between the area of the largest dot and the area of the smallest dot is larger than 60% for each color.), and the color balance of the color image is lost.

(Impractical Level)

"Periodic Image Defects"

Occurrence of image defects (such as black spots (including color spots), white blanks, or line-shape image defects), which correspond with the cycle of the photoreceptors were evaluated, using a monochrome image and a color image after printing 50000 sheets.

Evaluation criteria are as follows.

A: Almost no apparent periodic image defects are observed. (less than 4 spots/A4 size sheet for black spots, density not greater than 0.02 for line shapes: Excellent)

B: Occurrence of apparent periodic image defects is within a practical range. (4 to 10 spots/A4 size sheet for black spots, density ranging from 0.03 to 0.04 for line shapes: Practical level)

C: Apparent periodic image defects occurred in a range requiring reexamination about practicality. (11 to 20 spots/A4 size sheet for black spots, density ranging from 0.05 to 0.06 for line shapes: Requiring reexamination of practicability)

D: Many apparent periodic defects occurred. (more than 20 spots/A4 size sheet for black spots, density of 0.07 or higher for line shapes: Impractical level)

"Sharpness"

Sharpness of image was evaluated for the resolution of a monochrome image and a color image after printing 50,000 sheets with the criteria below.

A: Resolution of a line image equal to or higher than 16 lines/mm is achieved. (Excellent)

B: Resolution of a line image in the range from 10 to 15 lines/mm is achieved. (Practical level)

C: Resolution of a line image equal to or lower than 9 lines/mm is achieved. (Improper as a high resolution image)

"Tonal Resolution"

The evaluation conditions were changed into an environment with an ordinary temperature and humidity (20° C. and RH 60%); an original image having 60 tonal steps from a white image to a black solid image was copied; and then tonal resolution was evaluated. The evaluation was carried out by visual evaluation, with enough daylight, of images having tonal steps, and by the total number of steps of meaningful tonal steps.

A: more than 40 tonal steps (Excellent)

B: 21 to 40 tonal steps (Practical)

C: 11 to 20 tonal steps (Requiring reexamination of practicability: Practical for images in which tonal resolution is not significant)

D: less than 11 tonal steps. (Impractical)

Electric Potential Characteristic of Photoreceptor

As the electric potential characteristic of a photoreceptor, residual electric potentials (Vr) from the starting time to the time of printing 50,000 sheets were measured, and the variation width (ΔVr) was computed.

Other Evaluation Conditions

Charging conditions of photoreceptor: Electric potential at a non-image section was detected by an electric potential sensor to allow feedback control, setting the target potential to −800 V.

Image-wise exposure: Semiconductor laser (wavelength: 650 nm)

Image-wise exposure conditions: Semiconductor laser, Exposure spot area: $3.54\times10^{-10}$ $m^2$, 1200 dpi Neutralizing Conditions Regarding neutralizing conditions before charging, an LED light (of a light amount value equal to or greater than three times a light amount required to reach the electric potential at the exposure section) with a wavelength of 680 nm was projected. A value of the surface electric potential after neutralization was measured as a residual electric potential.

Developing conditions: Reverse development was performed with the developing agent described below.

Developing agent 1 Bk: A toner was prepared with colored particles (100 weight parts/volume average=5.2 μm/carbon black as a colored pigment) added with 0.5 weight parts of hydrophobic silica (hydrophobicity=75/number average primary particle diameter=12 nm) and 0.25 weight parts of 0.05 μm titanium oxide, and 45 μm ferrite carrier which is resin coated (in a mixture ratio of toner to carrier of 1/10 in weight ratio).

Developing agent 1Y: A developing agent which was prepared in the same way as the developing agent 1 Bk except that CI pigment yellow 185 was used instead of carbon black as a colored pigment of toner was used.

Developing agent 1M: A developing agent which was prepared in the same way as the developing agent 1 Bk except that CI pigment red 122 was used instead of carbon black as a colored pigment of toner was used.

Developing agent 1C: A developing agent which was prepared in the same way as the developing agent 1 Bk except that CI pigment blue 15:3 was used instead of carbon black as a colored pigment of toner was used.

TABLE 1

| Photo-receptor Group | CGL | CTL | | Cross-ing angle α | Monochrome image dot reproducibility | | | Color image dot reproducibility | | | Periodic image | Tonal | Sharpness | | Residual electric potential | Re- |
|---|---|---|---|---|---|---|---|---|---|---|---|---|---|---|---|---|
| No. | CGM | CTM | Layer thick-ness (μm) | (°) | S | 10,000 | 50,000 | S | 10,000 | 50,000 | defects | resolution | Monochrome | Color | (Δ Vr) | mark |
| 1 | G-1 | T-1 | 25 | 16 | A | A | B | A | A | B | B | B | A | A | 78 | *1 |
| 2 | G-1 | T-2 | 30 | 30 | A | A | A | A | A | A | A | A | A | A | 49 | *1 |
| 3 | G-1 | T-3 | 25 | 22 | A | A | A | A | A | A | A | A | A | A | 65 | *1 |
| 4 | G-1 | T-4 | 30 | 28 | A | A | A | A | A | A | A | A | A | A | 55 | *1 |
| 5 | G-1 | T-5 | 25 | 42 | A | A | B | A | B | B | A | B | B | B | 28 | *1 |
| 6 | G-1 | T-6 | 30 | 35 | A | A | A | A | A | A | A | A | A | A | 43 | *1 |
| 7 | G-2 | T-1 | 25 | 13 | A | B | C | A | B | C | D | C | A | A | 154 | *2 |
| 8 | G-2 | T-4 | 30 | 23 | A | A | A | A | A | A | A | A | A | A | 62 | *1 |
| 9 | G-2 | T-5 | 25 | 37 | A | A | A | A | A | A | A | A | A | A | 44 | *1 |
| 10 | G-2 | T-6 | 30 | 31 | A | A | A | A | A | A | A | A | A | A | 50 | *1 |
| 11 | G-2 | T-7 | 25 | 50 | B | C | C | C | C | C | B | D | A | A | 20 | *2 |
| 12 | G-1 | T-2 | 20 | 34 | A | A | A | A | A | A | B | B | A | A | 48 | *1 |
| 13 | G-1 | T-2 | 35 | 22 | A | A | A | A | A | A | A | A | A | A | 55 | *1 |

*1; According with the invention
*2; Not according with the invention

In the table, G-1 represents titanyl phthalocyanine pigment having a maximum peak of Bragg angle (2θ±0.2°) at 27.2° for a diffraction spectrum of characteristic X ray of CU-Kα.

G-2 represents hydroxy gallium phthalocyanine pigment having diffraction peaks of Bragg angle (2θ±0.2°) at least at positions of 7.5°, 9.9°, 12.5°, 16.3°, 18.6°, 25.1°, and 28.1° for a diffraction spectrum of characteristic X ray of CU-Kα.

T-1 to T-7 represents the following charge transport materials.

T-1

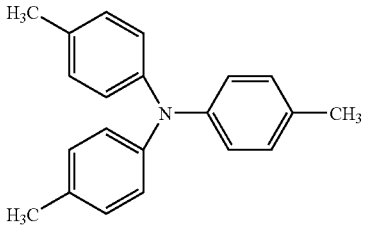

T-2

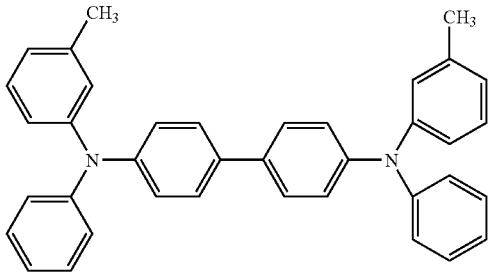

T-3

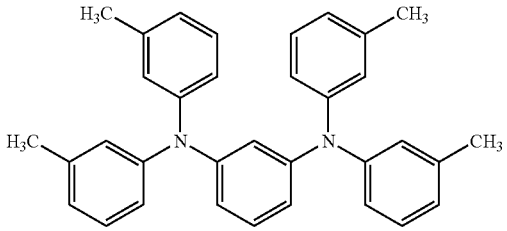

T-4

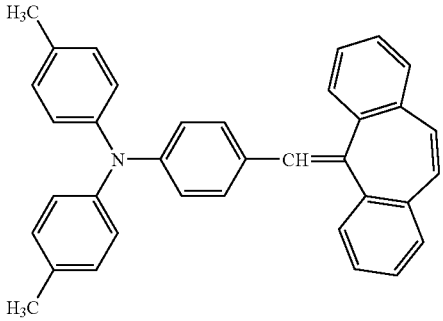

(10%)

+

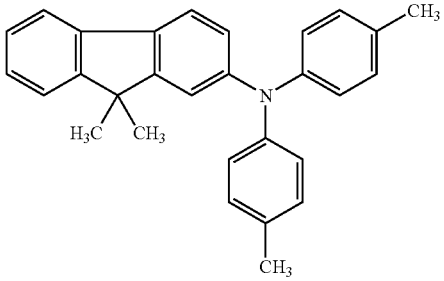

(90%)

-continued

T-5

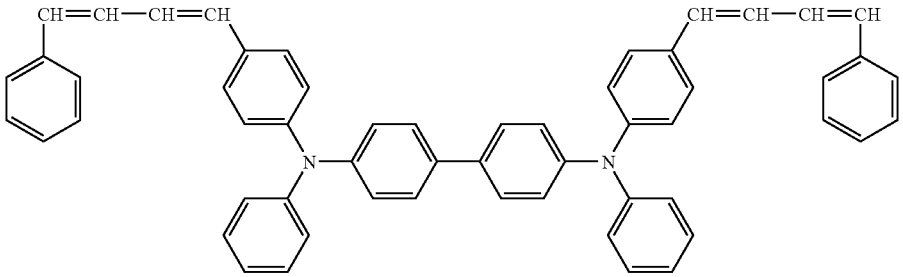

T-6

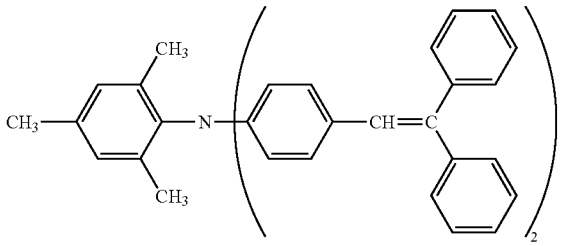

T-7

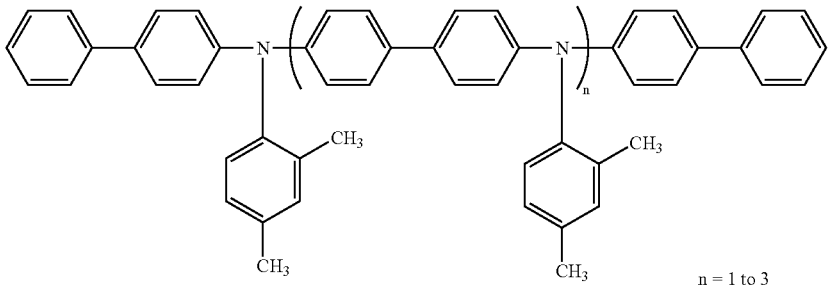

n = 1 to 3

It is apparent from Table 1 that the photoreceptor Groups 1 to 6, Groups 8 to 10, Group 12, and Group 13 of the invention for which a crossing angle α is in the range from 15 to 45 degrees, the crossing angle α being formed by two tangent lines which are tangent to a curve that is obtained by plotting integral values of a detected current with respect to time, the detected current being obtained by measurement of transient photocurrent (TOF) of the photoreceptor for an electric field intensity of 10 V/μm, have excellent dot reproducibility of monochrome and color images, thereby having an excellent tonal resolution and sharpness, and causing fewer image defects and a smaller rise of residual electric potential. Particularly, the photoreceptor Groups 2 to 4, 6, 8 to 10, and 13, for which the crossing angle α is in the range of 20° to 40° and the layer thickness of the charge transport layer is in the range of 25 to 35 μm, have remarkably improved effects on the respective items for evaluation. On the other hand, in the photoreceptor Group 7 (with a crossing angle α of 13°), for which the crossing angle α is not in the range that accords with the invention, dot reproducibility of both monochrome images and color images is degraded with increase in the number of print sheets, causing periodic image defects and a greater rise of residual electric potential. In the photoreceptor Group 11 (with a crossing angle α of 50°), for which the crossing angle α is not in the range that accords with the invention, dot reproducibility of both monochrome images and color images is greatly degraded, and tonal resolution is also degraded.

<Evaluation 3: Image Evaluation>

The photoreceptor Groups 1 to 6, 8 to 10, 12, and 13 that accord with the invention were used for evaluation, wherein the image-wise exposure conditions in Evaluation 2 were changed as follows.

Image-wise exposure conditions: exposure spot area: $9.00\times10^{-11}$ $m^2$, 2400 dpi Evaluation Result Even under the exposure condition of 2400 dpi, the respective evaluation items for the photoreceptor Groups 1 to 6, 8 to 10, 12, and 13 of the invention showed almost the same evaluation results as those in the case of the exposure condition of 1200 dpi.

<Evaluation 4: Image Evaluation>

The photoreceptor Groups 1 to 6 that accord with the invention were used for evaluation, under the same conditions as those in Evaluation 2 except that the charging condition of photoreceptors used in Evaluation 2 was changed as below. Table 2 shows the evaluation results.

Charging conditions of photoreceptor: The electric potential at the non-image section was detected by an electric potential sensor, allowing feedback control, and the target potential was set to −400 V.

TABLE 2

| Photo-receptor Group | CGL | CTL | | Cross-ing angle α | Monochrome image dot reproducibility | | | Color image dot reproducibility | | | Periodic image | Tonal | Sharpness | | Residual electric potential | Re- |
|---|---|---|---|---|---|---|---|---|---|---|---|---|---|---|---|---|
| No. | CGM | CTM | Layer thick-ness (μm) | (°) | S | 10,000 | 50,000 | S | 10,000 | 50,000 | defects | resolution | Monochrome | Color | (Δ Vr) | mark |
| 1 | G-1 | T-1 | 25 | 16 | A | A | A | A | A | A | A | A | A | A | 78 | *1 |
| 2 | G-1 | T-2 | 30 | 30 | A | A | A | A | A | A | A | A | A | A | 49 | *1 |
| 3 | G-1 | T-3 | 25 | 22 | A | A | A | A | A | A | A | A | A | A | 65 | *1 |
| 4 | G-1 | T-4 | 30 | 28 | A | A | A | A | A | A | A | A | A | A | 55 | *1 |
| 5 | G-1 | T-5 | 25 | 42 | A | A | B | A | A | B | A | B | A | A | 28 | *1 |
| 6 | G-1 | T-6 | 30 | 35 | A | A | A | A | A | A | A | A | A | A | 43 | *1 |
| 1 | G-1 | T-1 | 25 | 16 | A | A | A | A | A | A | A | A | A | A | 78 | *1 |
| 2 | G-1 | T-2 | 30 | 30 | A | A | A | A | A | A | A | A | A | A | 49 | *1 |

*1; According with the invention
*2; Not according with the invention

It is understood that, with a target electric potential set to −400 V as a charging condition, the photoreceptor Groups 1 to 6 according to the invention have improved effects on periodic image defects, sharpness, and tonal resolution, which are further improved compared with the case of the target potential being −800 V in Evaluation 2.

<Evaluation 5: Image Evaluation>

The photoreceptor Groups 1 to 6 that accord with the invention were used for evaluation, under the same conditions as those in Evaluation 4 except that the charging condition of photoreceptors used in Evaluation 4 was changed as below.

Charging condition of photoreceptor: Electric potential at the non-image section was detected by an electric potential sensor, allowing feedback control, and evaluation was performed at 2 levels of target electric potential being −200 V and −300 V.

Evaluation Results

In the case of setting the charging electric potential to −200 V and −300 V, the photoreceptor Groups 1 to 6 according to the invention showed almost the same effects as those in the case of the target electric potential being −400 V in Evaluation 4.

By utilizing an organic photoreceptor of the invention, it is possible to form a high quality dot image with a resolution of 1200 dpi or higher, provide an electrophotograpic image with a sharpness having no image failure and having an excellent tonal resolution, and provide a process cartridge using the organic photoreceptor, an image forming apparatus, and an image forming method.

What is claimed is:

1. An image forming method comprising steps of:

charging an organic photoconductor which comprises a conductive base, a charge generating layer having a layer thickness of 20 to 35 μm and a charge transport layer, wherein the charge generating layer and the charge transport layer are provided in this order on the conductive base, and wherein when a curve is drawn by plotting integrated-values of a detected current in terms of time in measurement of transient photocurrent by TOF (time of flight) measurement with an electric field intensity of 10V/μm, crossing angle θ of two tangent lines tangent to the curve is 15° to 45°, exposing the charged organic photoconductor with a light beam based on digital image data so as to form a dot latent image with a resolution of 1200 dpi or more, and developing the dot latent image formed on the organic photoconductor so as to form a toner image.

2. The image forming method of claim 1, wherein the organic photoconductor is charged in charging potential of −200 to −400V.

3. The image forming method of claim 1, comprising rotating the organic photoconductor in line speed of 300 mm/sec or more.

4. An image forming apparatus, comprising:

an organic photoconductor which comprises a conductive base, a charge generating layer having a layer thickness of 20 to 35 μm and a charge transport layer, wherein the charge generating layer and the charge transport layer are provided in this order on the conductive base, and wherein when a curve is drawn by plotting integrated-values of a detected current in terms of time in measurement of transient photocurrent by TOF (time of flight) measurement with an electric field intensity of 10V/μm, crossing angle θ of two tangent lines tangent to the curve is 15° to 45°, an charging member to charge the organic photoconductor, an exposure member to expose the charged organic photoconductor with a light beam based on digital image data so as to form a dot latent image on the organic photoconductor with a resolution of 1200 dpi or more, and a developing member to develop the dot latent image formed on the organic photoconductor so as to form a toner image.

5. The image forming apparatus of claim 4, wherein the crossing angle θ is 20° to 40°.

6. The image forming apparatus of claim 4, wherein the film thickness of the charge transport layer is 25 to 35 μm.

7. The image forming apparatus of claim 4, wherein the charge transport layer contains a charge transport material of triphenylamine derivatives, styryl compounds, benzidine compounds and butadiene compounds.

8. The image forming apparatus of claim 4, wherein the charge transport layer contains a resin of polystyrene resins and styrene-butadiene copolymers as a binder.

9. The image forming apparatus of claim 8, wherein the charge transport layer contains the charge transport material of 50 to 200 weight parts to the binder of 100 weight parts.

10. The image forming apparatus of claim 4, further comprising: a surface protective layer.

11. The image forming apparatus of claim 4, further comprising an intermediate layer between the charge transport layer and the conductive base.

12. The image forming apparatus of claim 11, wherein volume resistance of the intermediate layer is $1\times10^8$ Ω·cm or more.

13. The image forming apparatus of claim 11, wherein the intermediate layer comprises particles of N type semiconductor.

14. The image forming apparatus of claim 4, wherein the charging member charges the organic photoconductor in charging potential of about 200 to about 400V.

15. The image forming apparatus of claim 4, comprising a photoconductor actuating member capable to drive the organic photoconductor in line speed of 300 mm/sec or more.

16. The image forming apparatus of claim 4, wherein the charging member charges the organic photoconductor in charging potential of −200 to −400V.

17. The image forming apparatus of claim 15, wherein the exposure member records a digital image onto the organic photoconductor in resolution of 1200 to 3000 dpi.

* * * * *